United States Patent [19]

Fasham

[11] Patent Number: 4,706,996

[45] Date of Patent: Nov. 17, 1987

[54] HOSPITAL FORM SET WITH DETACHABLE BAG

[75] Inventor: Thomas I. K. Fasham, Brighton, England

[73] Assignee: Moore Business Forms, Inc., Grand Island, N.Y.

[21] Appl. No.: 649,539

[22] Filed: Sep. 11, 1984

[30] Foreign Application Priority Data

Sep. 14, 1983 [GB] United Kingdom ..... 8324568

[51] Int. Cl.[4] ..... B41L 1/20; B41L 1/22

[52] U.S. Cl. ..... 282/1 R; 282/11.5 R; 282/25; 283/1 B; 283/900; 206/232; 229/71

[58] Field of Search ..... 282/1 R, 11.5 R, 25, 282/29 R; 211/57.1, 59.1; 229/71, 74, 69; 206/232, DIG. 806; 383/39; 283/1 B, 900

[56] References Cited

U.S. PATENT DOCUMENTS

| | | | |
|---|---|---|---|
| 1,206,351 | 11/1916 | Meyers | 283/1 B |
| 2,614,350 | 10/1952 | Kneifel et al. . | |
| 2,983,525 | 5/1961 | Mercur | 282/25 |
| 3,402,749 | 3/1967 | Kinzler | 383/63 |
| 3,837,565 | 9/1974 | Johnsen | 282/11.5 A |
| 3,986,613 | 10/1976 | Mayer | 211/57.1 |
| 4,153,163 | 5/1979 | Alderman et al. | 206/610 |
| 4,415,087 | 11/1983 | Clayton et al. . | |
| 4,485,929 | 12/1984 | Betts, Sr. | 211/59.1 |

*Primary Examiner*—Mark Rosenbaum
*Assistant Examiner*—Taylor J. Ross
*Attorney, Agent, or Firm*—Allegretti, Newitt, Witcoff & McAndrews, Ltd.

[57] ABSTRACT

This invention is concerned with a business form assembly for use in hospitals and capable of recording details of a medical test, for example, a blood test. The assembly comprises a forms sheet and a bag capable of receiving a container containing a test sample and having closure means at the mouth of the bag to secure the container in the bag. The bag is secured to the forms sheet by adhesive. The business forms assembly is conveniently mounted on a retainer system comprising a continuous bar with a plurality of removable limbs with the lower limb passing through respective apertures in the assemblies.

5 Claims, 6 Drawing Figures

HOSPITAL FORM SET WITH DETACHABLE BAG

BACKGROUND OF THE INVENTION

FIELD OF THE INVENTION AND DESCRIPTION OF THE PRIOR ART

This invention has reference to business form assemblies and has particular reference to business form assemblies for use, for example, in hospitals which are capable of recording details of a medical test, for example, a blood test and have means associated with the business form assembly for securing a sample of the medical test.

In British Patent Specification No. 2081215, there is described a bag with a compartment to receive a container, for example a blood sample and another compartment to receive a separate form to carry information about the sample. Adhesive means are provided to close the compartment for the sample container.

SUMMARY OF THE INVENTION

It is an object of the present invention to provide a combined business form and bag capable of receiving a sample containing a blood or other medical sample.

According to the present invention, a business form assembly comprises a business forms set with provision for receiving information about a medical test and a bag having closure means at the mouth of the bag to secure in the bag a container for receiving a medical test sample and wherein the bag is secured by adhesive to the business form set. Conveniently, the invention also comprises a business forms retainer system including a continuous bar having a plurality of removable limbs, the lower limbs of which are capable of supporting a plurality of business forms assemblies and which lower limb passes through an aperture in the respective assemblies.

BRIEF DESCRIPTION OF THE DRAWINGS

A business forms assembly in acordance with the present invention will now be described with reference to the accompanying drawings wherein.

DETAILED DESCRIPTION OF THE PREFERRED EMBODIMENTS

Figure 1:
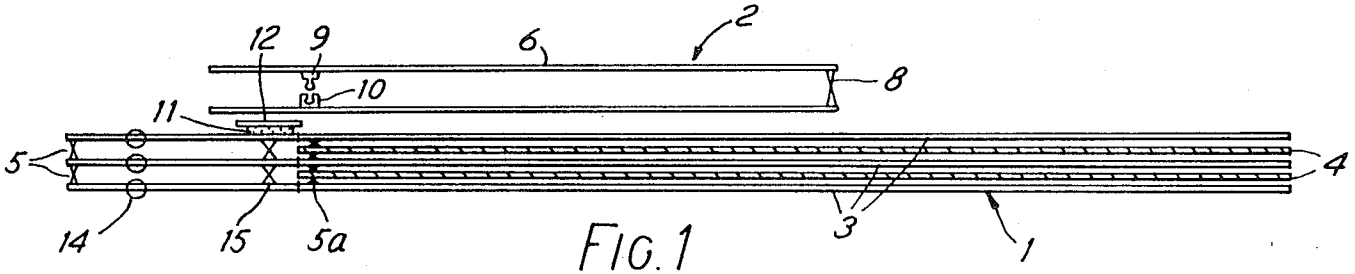
FIGS. 1 and 2 are each a plan view of the business forms assembly.

Referring to the drawings, there is shown a business forms assembly including a forms set 1 and a bag 2 to contain a container for a blood or other medical sample.

Figure 2:
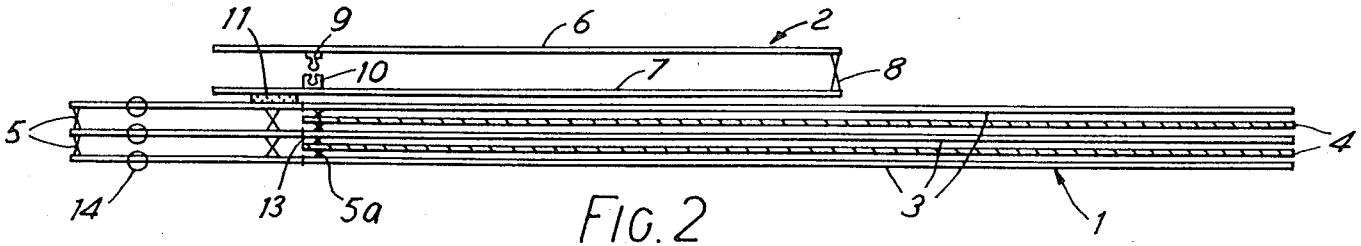

FIG. 1 shows the forms set 1 separate from the bag 2 but in FIG. 2 the bag 2 has been secured to the forms set 1.

Figure 3:
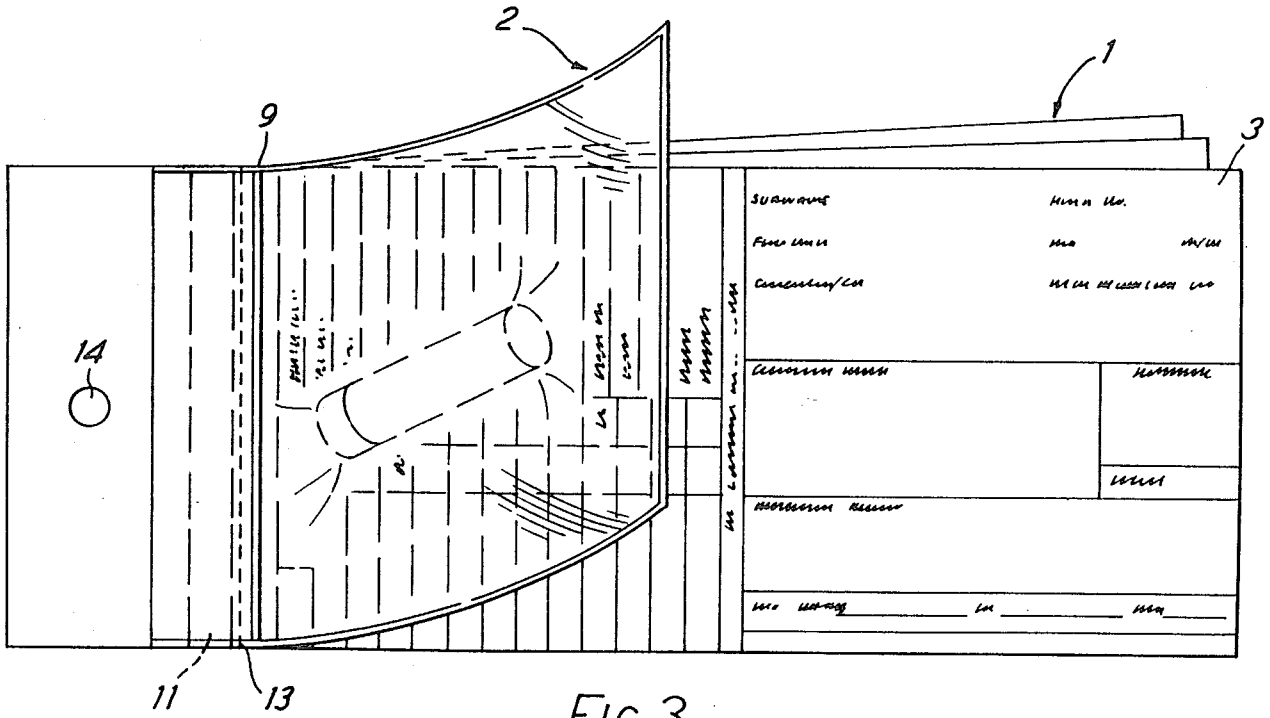
FIG. 3 is a side view of the business forms assembly.

The forms set shown comprises three record sheets 3 with interleaved sheets of carbon paper 4 located between adjacent record sheets 3. The sheets of carbon paper 4 extend to the bottom end of the forms set and their bottom edge is in line with the bottom edge of the record sheets 3. However, the top edge of the carbon paper sheets terminates short of top edge of the record sheets 3. The sheets 3 are secured together by lines of adhesive 5 extending at the stub or top end of the forms set transversely between each of the record sheets 3. Likewise, the sheets of carbon paper 4 are secured to both front and rear faces of adjacent record sheets by respective lines of adhesive 5*a*. As shown in FIG. 3, the sheets 3 are designed to receive recorded information. Data is included on the record sheets such as relates to matters so arranged that information may be recorded in relation to a blood test. However, the record sheets may record information related to other tests as may be carried out especially in hospitals, such as urine tests or other tests embodying body liquids or solids. The record sheets are preferably identical, the one with the other, as regarding data printed on sheets 3. In any case, the data on the forms sets is arranged so that information recorded on the first record sheet of the set is recorded on the corresponding underlying record sheets.

The forms set may be produced as a continuous interleaved web with each of the record sheets 3 forming part of a continuous web (not shown) with margins having feed apertures by means of which the webs may be collated and the webs brought into register, the one with the other, as well as for feeding purposes.

A line of adhesive 11, which extends across the width of the first sheet of the forms set, is utilized to secure the bag to the uppermost record sheet of the forms set 1. The line of adhesive is preferably a double sided line of adhesive, that is to say consists of a line of adhesive on each of the opposite sides of a strip of supporting material. One line of adhesive secures the adhesive to the forms set and the other enables the bag to be secured to the forms set. A strip of barrier coating 12 is applied over the line or adhesive which strip is removed prior to having the bag secured.

A tear-off line of perforation is arranged in each one of the sheets of the forms set 1 spaced a short distance from the head of the forms set but beyond the line of adhesive 5A. This enables the sheets of the forms set to be detached from the stub of the forms set, leaving the bag attached to the stub for processing in the hospital laboratories or the like. It will be appreciated that, by virtue of having the line of adhesive 11, the stub part of the forms set is extended.

In a modified arrangement the forms set may be made up from sheets of self copy paper, for example as sold under the Trademark MCP, in which case the sheets of carbon paper are not required.

The forms set 1 has an aperture 14 extending through all the parts of the set 1 in the extended stub part so that the business forms assembly may be suspended on a filing post or in a rail type suspension system, to be hereinafter described, to facilitate transport to the hospital laboratory or for storage purposes until such time as they are required.

Another feature concerns the provision of an additional line of adhesive adjacent the strip perforation 13 in order to secure the parts of the assembly together when the parts are inserted into a blood count machine (for example, a Coulter machine), or when the set of forms is used for recording a manual report. As shown in FIGS. 1 and 2 a further line of adhesive 15 is positioned below the line of of adhesive 11 on the back of the first sheet of the sheets 3 and between all parts of the set in the same position. This is designed to ensure that the weight of the bag and any specimen contained therein does not tear the paper from the stub and endanger the specimen.

The bag 2 comprises a front sheet 6 and a rear sheet 7 closed at the bottom of the bag (as shown in FIG. 2) by a transverse line of heat seal 8 extending across the bottom of the bag. Alternatively, the bag may be formed of a single sheet folded at its bottom end. The bag is made of transparent plastics material capable of being heat sealed. The bag is secured to the forms set by a line of adhesive 11 located between the rear face of the rear sheet 7 of the bag and the front face of the first of the record sheets 3 and located adjacent to the mouth of the bag. This line of adhesive 11 is preferably a double sided adhesive strip applied to the form set 1 and covered by a barrier sheet prior to having the bag 2 applied to the forms set 1.

The bag has a closure means adjacent to its mouth to ensure that anything contained in the bag does not escape. As shown in FIG. 2, the closure means comprises a rib member 9 positioned on the inner face of the front sheet 6 and a channel member 10 positioned on the inner face of the rear sheet 7 with the rib member 9 and channel member 10 so positioned that they interlock when pressed together. As shown, the rib member is made of transparent plastics material with a re-entrant head part extending longituninally of the rib. Similarly, the channel member has a re-entrant part extending longitudinally of the channel to receive the head part of the rib to retain the rib and channel parts togehter. Both the rib member 9 and channel member 10 extend across the width of the bag 2. Preferably, the rib member 9 and channel member 10 are formed as an integral part of the respective sheets of the bag. The bag may be of the kind sold under Trademark MINIGRIP.

A business form assembly, according to the invention, is made by printing each of the respective form parts in a continuous web and applying adhesive to them to create a forms set 1 as shown in FIGS. 1 and 2. The double sided line of adhesive 11 is also applied to the forms set 1. The aperture 14 is also punched for vertical suspension of the forms set 1. The forms sets 1 and bags 2 are brought together perhaps by the doctor or technician dealing with the processing of blood or other medical sample. The securing together of the forms set 1 and bag 2 is achieved by removing the barrier sheets and applying the bag to the forms set.

Some information about the blood or other medical sample will have been applied to the forms set, prior to the bag being secured to the forms set and the blood or other sample is located in a phial which is located in the bag which is subsequently sealed. Even if the phial leaks, the sample liquid is maintained inthe sealed bag as the bag is transported vertically on a vertical transport system to be described. On receipt in the laboratory the set of forms is detached from the stub to which the bag is still attached. The specimen is removed for analysis and the set of forms is still held together by glueline 5A and used to record details of analysis either manually or mechanically.

Figure 4:
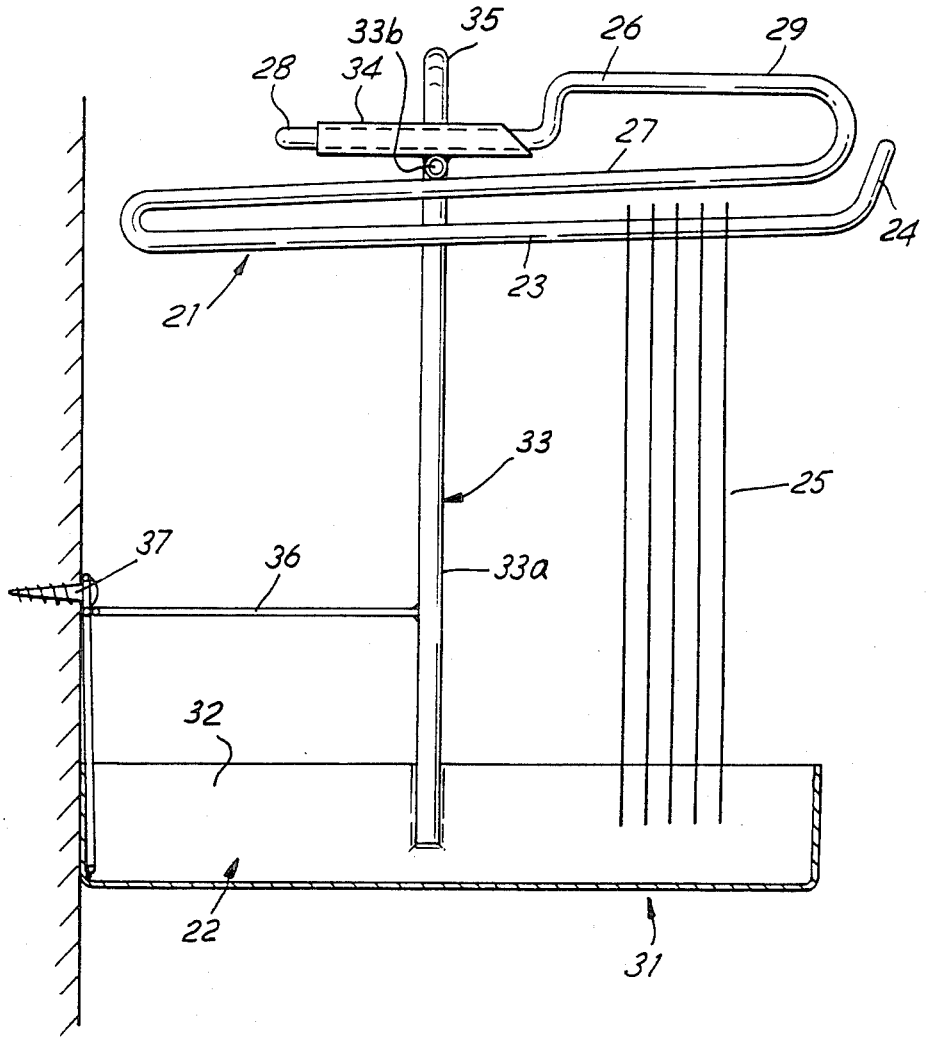
FIG. 4 is a side view of a forms assembly supported on a filing tray.
Figure 5:
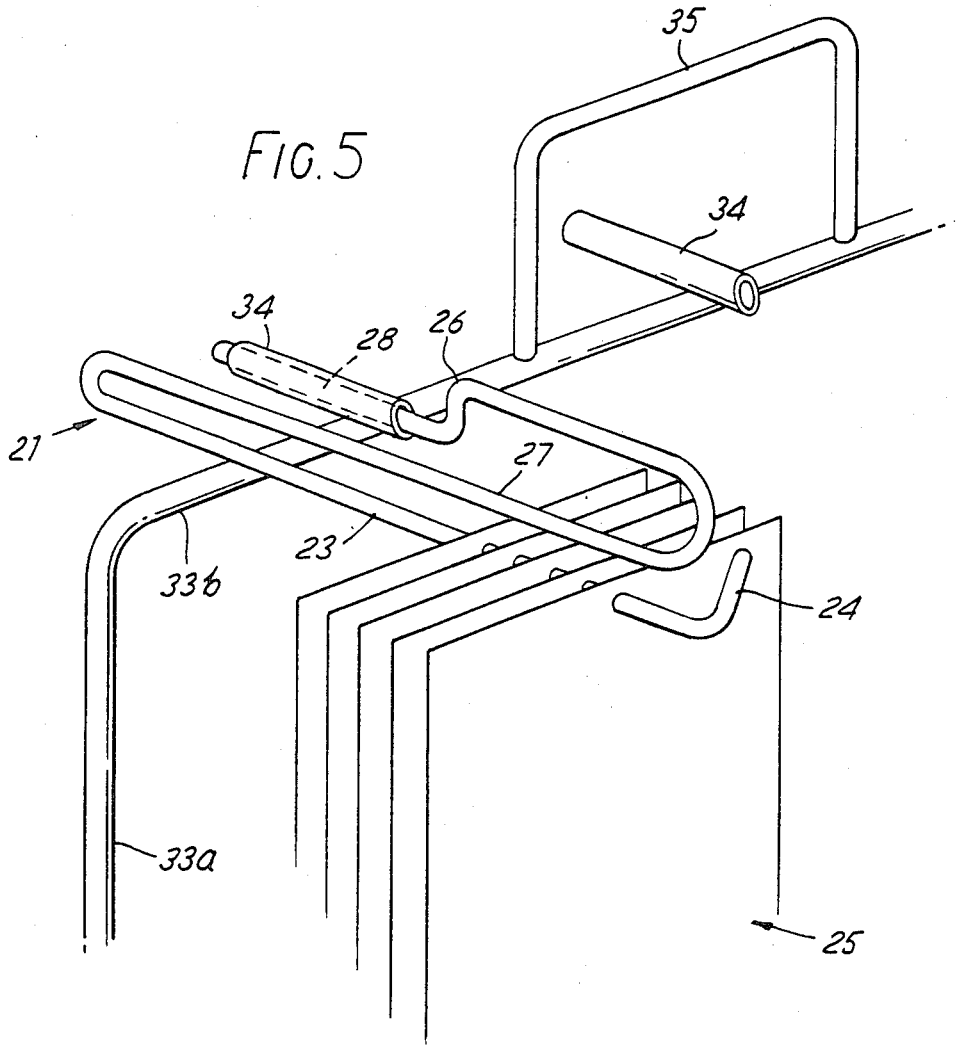
FIG. 5 is a diagrammatic perspective view corresponding to FIG. 4.
Figure 6:
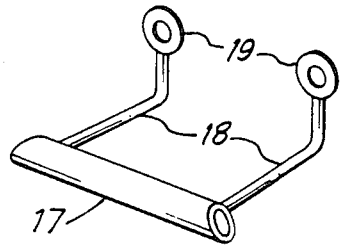
FIG. 6 is a diagrammatic view of an alternative support.

Referring to FIGS. 4 and 5 of the drawings there is shown a record retainer 21 located on a tray 22 in a carrying case (only part of which is shown in FIG. 6). The record retainer 21 comprises a continuous bar of metal, for example of steel, covered by a covering of plastics material, for example, polyethylene or polypropylene but preferably of nylon. The nylon covering may be applied by heating the metal assembly and then dipping in nylon powder or nylon preformer powder. The plastics material must be capable of withstanding steam cleaning and sterilizing, as in an Autoclave. The bar includes a lower limb 23 which is substantially straight and positioned tilting slightly backwards so as to allow specimens to slide backwards but has an upwardly curved free end part 24. This lower limb 23 has a diameter slightly less than the diameter of an aperture formed adjacent the upper edge of a business forms assembly, shown in FIGS. 1 and 4, divided into a single form and bag length as shown diagrammatically at 25.

The bar also includes an upper limb 26 integrally connected to the lower limb 23 by an intermediate portion 27 to form a carrying handle so that specimens will slide down when removed by hand from the main assembly. Adjacent its outer end the upper limb 26 has a diameter the same as the diameter of the lower limb 23 and has a straight portion 28 positioned substantially horizontal. At about the mid part of the upper limb the limb bends upwardly and then bends to a further substantially horizontal portion 29 but is spaced from the intermediate portion 27 by a larger distance than the distance between the straight limb position and the intermediate portion. The outer end of the further horizontal portion 29 terminates in a bend which joins the intermediate portion 27.

The record retainer is capable of supporting the forms records 25 on its lower limb 23 and of being supported by a sleeve 34 on the tray 22 or in a case to be hereinafter described.

The tray comprises a drip tray base 31 of rectangular form with shallow side walls 32 at each side. An integral handle member 33 with vertical side parts 33*a* and a horizontal top part 33*b* is secured at the lower end of its vertical side parts 33*a* to the respective side walls, as by welding.

A plurality of sleeves 34 are secured, as by welding, to the horizontal top part 33*b* of the handle member. The end of the sleeve 34 to receive the record retainer is chamfered to facilitate insertion of the record retainer in the sleeve.

The longitudinal center line of each respective sleeve is positioned above and at right angles to the horizontal top part 33*b* and each is secured to the top part by welding.

The sleeves are each located in a horizontal plane in the record retainer shown. It is intended to have three sleeves secured to the top part 33*b* with the sleeves so spaced so that the forms records 25 each has a depth of approximately nine and one half ($9\frac{1}{2}$) inches (24 centimeters) and a width of approximately five (5) inches (13 centimeters). The forms records assemblies lie close to the tray 22 and the forms records assemblies are positioned in groups which groups lie close to one another side by side.

The handle member 33, as shown, has a carrying handle 35 of similar bar material covered with plastics material which is secured to the top part 33*b*. Also an extension 36 is formed from the respective side parts and has an eye portion which enables the assembly to be mounted on a wall or other surface as by a screw 37. The tray is also covered with a coating of nylon or other plastics material. The covering is provided in order that the record retainer and tray may be capable of being subjected to heat treatment such as steam cleaning, as in an Autoclave for sterilization purposes.

When a record retainer as described is to be used, the requested details, for example of a medical test, are entered on a forms record and a sample (for example blood) is taken and inserted into a container which in turn is placed in the bag or envelope of the forms records. The bag or envelope is then closed and the forms record is placed on the record retainer with the aperture 14 in the forms record engaged on the lower limb 23. In the record retainer described, there are three separate record retainers so one retainer may be used to receive sample tests relating for example to HAEMATOLOGY, another for MICRO BIOLOGY and the third for CLINICAL CHEMISTRY.

When enough forms records are mounted on the record retainer, the record retainer is carried by the horizontal carrying portion to the tray where the upper limb engages a selected one of the sleeves 34. When the sleeves are engaged, the tray with the record retainer is carried to the appropriate laboratory for testing where the records are dealt with and further information about the samples is recorded on the forms records and they are further processed.

If desired instead of supporting the record retainers on the tray member shown in FIGS. 4 and 5, they may be supported on a sleeve 17 which is secured as by welding to a pair of brackets 18, each with an eye 19 which enables the sleeve to be secured as by screws to a wall or other surface. The opposite ends of the sleeve are chamfered to enable the retainer to be located within the sleeve from either of the two ends as shown in FIG. 6.

By this invention, we are able to provide an improved business forms assembly by the use of which the making and recording of blood and other medical samples are effectively simplified.

What is claimed is:

1. A medical business form system comprising, in combination, a business form set having a plurality of interleaved record sheets with transfer material, said set having means associated with said record sheets for receiving information relating to a medical test specimen, a liquid impervious bag for receiving a container containing said medical test specimen, an open end for passage of said container therethrough, said bag having liquid impervious closure means along said open end for ensuring that the contents of said bag are prevented from escaping therefrom, said bag being constructed to prevent leaking therefrom if liquid contents escape from said container located in said bag, and means for detachably securing said bag to a face of one of said record sheets of said business form set, said bag being sized and positioned so as to be substantially confined within the periphery of said form set, said bag and said container being separable from said business form set for analysis for said specimen while said form set is maintained intact for recording the details of said analysis.

2. A business forms system according to claim 1 where each of the record sheets has a line of tear-off perforations for enabling the record sheets to be detached from the assembly.

3. The business form system of claim 1, including means for supporting said form set and said bag in a substantially vertical position, and means on said business form set for detachably securing said form set to said supporting means.

4. A business forms system according to claim 1 wherein said bag is made of transparent plastic material and said closure means at said open end of the bag comprises a rib member and channel member, the rib member being engaged in the channel to close the bag.

5. A business forms system according to claim 4 wherein the rib and channel each have reentrant parts.

* * * * *